United States Patent [19]

Smith et al.

[11] 4,324,066

[45] Apr. 13, 1982

[54] ARTIFICIAL EYE HAVING DOUBLE CONVEX MAGNIFYING LENS

[76] Inventors: Lori J. Smith, 915 N. Wetherly Dr., West Hollywood, Calif. 90069; James J. Alser, 5460 White Oak, Encino, Calif. 91316

[21] Appl. No.: 137,527

[22] Filed: Apr. 4, 1980

[51] Int. Cl.[3] ..... A63H 3/42

[52] U.S. Cl. ..... 46/165; 156/278; 264/1.7; 264/132; 264/250

[58] Field of Search ..... 46/165, 170; 3/13

[56] References Cited

U.S. PATENT DOCUMENTS

| | | | |
|---|---|---|---|
| 1,268,885 | 6/1918 | Sampson | 3/13 |
| 1,373,579 | 4/1921 | Wendtland | 46/165 |
| 1,979,321 | 11/1934 | Dunner | 46/165 |
| 1,993,121 | 3/1935 | Travers | 3/13 |
| 2,195,315 | 3/1940 | Lustfield et al. | 46/165 |
| 2,394,400 | 2/1946 | Noles | 3/13 X |
| 2,466,278 | 4/1949 | Rupert | 46/165 |
| 2,603,791 | 7/1952 | Jardon et al. | 3/13 |
| 2,692,391 | 10/1954 | Gougelman | 3/13 |

*Primary Examiner*—F. Barry Shay
*Attorney, Agent, or Firm*—Lyon & Lyon

[57] ABSTRACT

A realistic, durable, and easy to mount artificial eye comprises an opaque, bulbous base and a convex, rigid, substantially transparent lens secured to the base. Between the lens and the base is an image of an eye, the image being visible through the lens. Preferably the lens is secured to the base by a film of substantially transparent polymeric material.

8 Claims, 2 Drawing Figures

ARTIFICIAL EYE HAVING DOUBLE CONVEX MAGNIFYING LENS

BACKGROUND

Figure 1:
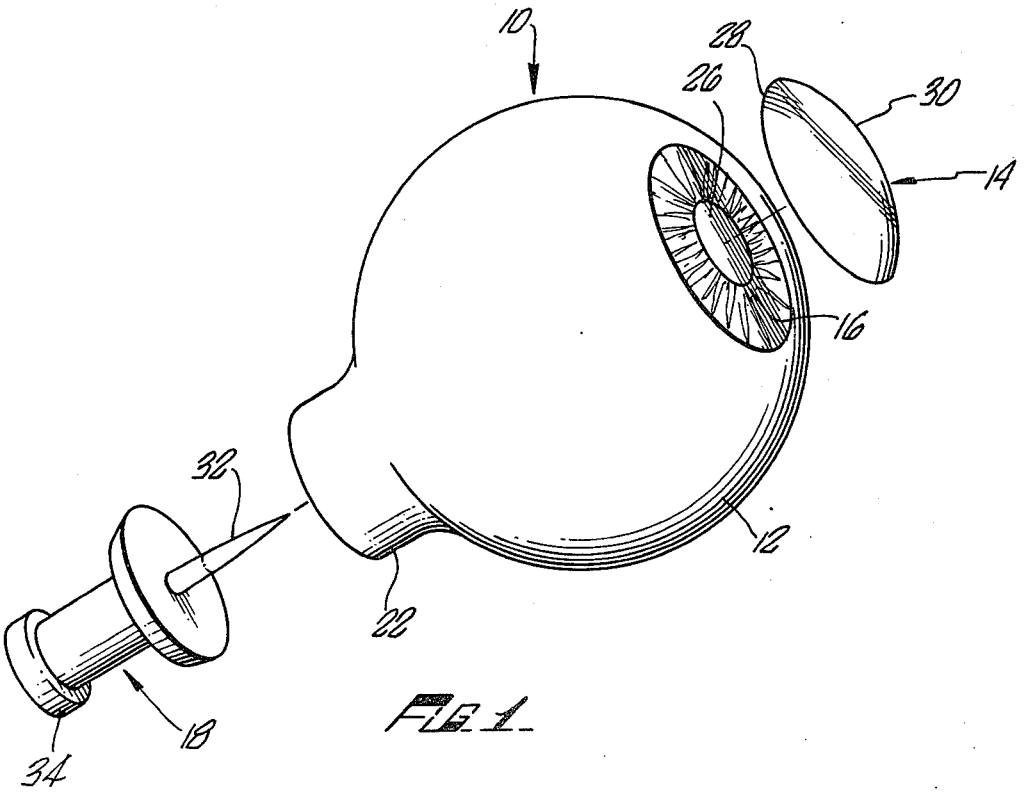

This invention relates to artificial eyes, and particularly artificial eyes used for mannequins.

It is important that an artificial eye for a mannequin have a lifelike, sparkling appearance if the mannequin is to be attractive. The most popular artificial eye is one made of glass and imported into the United States. The glass eye has a bulbous glass base, with a glass insert that is painted or pigmented to look like the iris and pupil of the human eye. The glass insert is mounted in a concave recess in the base.

Although the glass eye has a lifelike appearance, it suffers from many serious disadvantages. First, it is a handcrafted item, produced by a cottage industry labor force, and thus, there are great variations in quality and appearance from one eye to another. Even the two eyes that are to make a pair of eyes can differ from each other. In addition, the supply of the eyes to the United States is erratic and undependable.

Another disadvantage with the glass eye is that it is breakable, both in shipment and in use. Furthermore, there is no handle or other mounting means for easy mounting of the eye into a mannequin.

Another problem with the glass eyes is the expense involved. The workers who produce the eyes are generally skilled craftsman, and can require a premium in wages.

Therefore, it is obvious there is a need for a low cost, lifelike, durable eye which can be produced dependably and reproducibly.

SUMMARY

The present invention is directed to an artificial eye with these features. The eye comprises an opaque, bulbous base and a convex, substantially transparent cap secured to the base. Preferably the base is shaped much like a light bulb, but has a flattened crown portion where the cap is secured. An image of an eye is attached to the base between the cap and the base, where the image is visible through the cap. The image can be painted onto the base, or can be applied by a decal. The cap can be secured to the base by a film of substantially transparent polymeric material.

For durability, preferably the base, cap, and film are all formed from rigid plastic materials that are substantially unbreakable in use.

This artificial eye can be produced inexpensively and reproducibly. The base can be cast from a curable polymeric resin such as polyester. The image of the eye can be formed from easily reproduced decals so that each eye is substantially identical to another eye. By the use of the cap, the image of the eye appears sparkly and lifelike, the cap giving a controllable prism effect.

Mounting means for mounting the eye in a mannequin can be secured to the base, preferably at a location diametrically opposed to the cap. When the base is formed of a curable resin, the mounting means can be inserted into the base while the resin is only partially cured. When the resin is completely cured, the mounting means is held firmly within the base.

The cap and film can be formed from the same material such as a substantially transparent epoxy resin.

DRAWINGS

Figure 2:
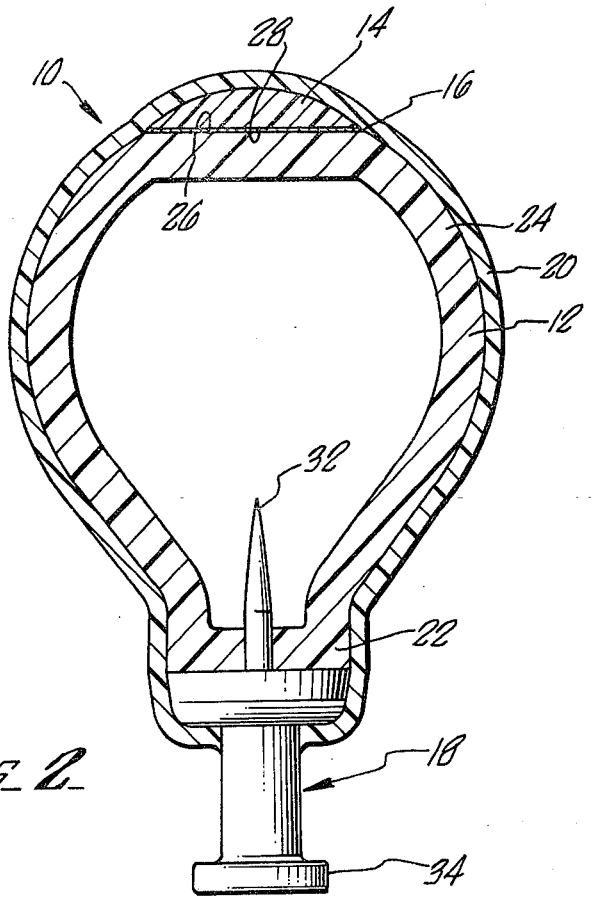

These and other features, aspects, and advantages of the present invention will become better understood with reference to the following description, appended claims, and accompanying drawings where:

FIG. 1 is an exploded perspective view of an artificial eye according to the present invention; and FIG. 2 is a longitudinal sectional view of another version of an artificial eye according to the present invention.

DESCRIPTION

With reference to FIGS. 1 and 2, there is shown an artificial eye 10 according to the present invention. The eye comprises a bulbous base 12, a substantially transparent cap 14 secured to the base 12, and an image 16 of an eye between the cap 14 and the base 12, the image being visible through the cap 14. Mounting means for mounting the artificial eye 10 in a mannequin such as a push pin 18 is secured to the base 12. A substantially transparent, and preferably optically clear, exterior film or laminate 20 encases the cap 14 and the base 12.

The base 12 generally has the shape of a light bulb, having a relatively narrow neck portion 22 and a somewhat spherical main body portion 24. The crown 26 of the base, the portion opposite the neck portion 22, is flattened for receiving the cap 14.

Preferably the base 12 is rigid and solid (although shown hollow) to add durability to the artificial eye 10. Preferably the base is formed of an opaque material, being colored white or off-white, so that the artificial eye has a lifelike appearance.

The cap or lens 14 is formed of a substantially transparent, and preferably an optically clear, material. As used herein, the term "substantially transparent" means that the image of the eye is preserved. A substantially transparent material can be tinted or hued, or have slight imperfections such as bubbles, but should not adversely affect the aesthetic appearance of an eye. It is mounted on the flattened crown 26 of the base 12, and thus, preferably the bottom 28 of the cap 14 is also flattened for easy mounting to the flattened crown 26. In this configuration, the cap 14 is a plano-convex lens. Alternatively, but less preferably, the cap can be a double convex lens or a concave-convex lens.

Preferably the outward or top surface 30 of the cap 14 is convex. By making the cap convex, the image 16 of the eye as viewed through the cap appears very lifelike and sparkling. Preferably the cap acts as a convex lens, magnifying the pupil portion of the image of the eye by from about 10 to about 80%, and more preferably by about 40%. By acting as a convex lens, the cap adds three dimensional depth to the image of the eye as seen by an observer; thereby contributing to the realistic appearance. Depending on the refractive index of the material used for the cap, the curvature of the cap is such that the image of the eye is magnified.

The image 16 of an eye can be painted onto the flattened crown 26 of the base 12 such as with oil paints as shown in FIG. 1. Alternatively, the eye image 16 can be made in the form of decal to be adhered to the flattened crown 26 as shown in FIG. 2. An advantage of using decals is that they can be produced by photoreproduction processes based upon an actual human eye, and then mass produced so to guarantee reproducible quality and to insure that both eyes of a pair are substantially identical.

The push pin 18 is mounted in the neck portion 22 of the base 12 in a position preferably diametrically opposed from the cap 14. The sharp pin portion 32 of the push pin is mounted within the base 10 with the handle portion 34 extending outwardly from the base. This push pin makes it easy to manipulate and mount the artificial eye 10.

A variety of techniques can be used for securing the cap 14 to the base 12 such as use of adhesives. Preferably, as shown in the figures, the film or laminate 20 is used, the film being substantially transparent and encasing the cap 14 and the base 12, as well as a portion of the push pin 18.

The base is formed of a durable, substantially unbreakable, rigid, and opaque polymeric material. As used herein, the term "substantially unbreakable" means a material such that when an artificial eye 10 is dropped from six feet onto a cement floor, the artificial eye does not break. In fact, with the preferred materials for the components of the artificial eye as described hereinbelow, the artificial eye can literally be thrown against a wall without any damage occurring.

A wide variety of polymeric materials can be used for the base 12. Included are ABS; acetals; acrylics; allyls such as cast allyl diglycol carbonate; cellulosics such as cellulose acetate, cellulose proprionate, cellulose acetate butyrate, and cellulose nitrate; epoxy resins; ionomers; melamine-formaldehyde; nylons; phenol-formaldehyde; phenolic cast resin; phenylene oxides; polycarbonates; thermosetting polyesters; polystyrenes; urea formaldehyde; and rigid polyvinylchloride.

The material chosen preferably is one which can be pigmented white or off-white so the artificial eye 10 is realistic looking.

Preferred materials are thermosetting polyester resins because they are easy to handle, are substantially unbreakable, and can be pigmented as required.

The cap 14 and the film 20 are preferably formed of the same material. The material needs to be one which can be secured to the base 12, is substantially transparent, and is substantially unbreakable. Preferably the material used for the cap 14 and the laminate 12 does not yellow or otherwise discolor in use due to environmental effects such as ultraviolet light so it retains its transparency. Candidate materials include acrylics; allyls such as cast allyl diglycol carbonate; cellulosic such as cellulose acetate, cellulose proprionate, cellulose acetate butyrate, and cellulose nitrate; epoxy resins; ionomers; phenolic cast resins; polycarbonates; thermosetting polyesters; polystyrenes; and rigid polyvinylchloride.

A preferred material for the cap 14 and the laminating film 20 is an epoxy resin.

Preferably the push pin 18 is formed of metal for durability.

The eye 10 can be formed by cast molding the base 12 with the neck portion 22 at the open end of the mold. While the resin used for forming the base 12 is only partially cured, the push pin 18 is inserted into the neck portion 22. After the base 12 is completely cured, the image of the eye 16 is painted, or in the case of a decal mounted, onto the flattened crown 26. The cap 14 is likewise formed by cast molding.

Then a partially cured sticky film of the laminate material 20 is coated onto the exterior of the base 12, completely encasing the base. The cap 14 is then placed over the image of the eye at the flattened crown portion. Some additional material used to form the film is placed over the cap 14. The laminate can be applied in a thickness of from about 3 to about 10 mils. The stickiness of the partially cured laminate holds the cap in place and also serves to hold the push pin 18 in place. The laminate is then allowed to cure, thereby forming the completed artificial eye 10. The eye can be polished or buffed as required.

EXAMPLE

In an artificial eye according to the present invention, the base was made from thermosetting polyester resin. The resin was a two component system, one component being Crystal Clear Resin, Catalog No. PM111C from Plastic Mart Inc. of Santa Monica, Calif. The catalyst hardener used for the resin was methyl ethyl ketone peroxide in dimethylphthalate, available from H. H. Gerisch Products of Torrance, Calif. Two hundred drops of the hardener were used per quart of the Crystal Clear Resin. The resin was filled with one part calcium carbonate per three parts by weight resin. Titanium dioxide in a paste base was used as a pigment; about two ounces by weight of paste per quart by volume of the uncured resin were used.

The cap 14 and laminate 20 were formed from a two-component epoxy resin available under the tradename "Clear Polymer Finish" made by Crystal Sheen of Hayward, Calif.

The base was about 1.09 inches in diameter, had a height from the neck to the flattened crown of about 1.19 inches, and the flattened crown was circular with a diameter of about 0.58 inch. The cap was about 0.55 inches in diameter and had a maximum thickness of about 0.13 inch. The laminate was applied in a thickness of about 5 mils.

The artificial eye 10 of the present invention has many advantages over the prior art glass eye. It is virtually unbreakable, durable, and easy to handle and mount in a mannequin. Due to the use of the cap 14, the eye has a very lifelike appearance, the cap giving a sparkling or prism-like effect. Further, the eye can be mass produced reproducibly so that customers are insured of consistent quality. Relatively unskilled labor can be used for producing the artificial eye 10. In short, the eye 10 as compared to prior art glass eyes is a superior product that can be produced at lower cost.

Although the present invention has been described in considerable detail with reference to certain preferred versions thereof, other versions are possible. For example, rather than placing the image of the eye on the flattened crown 26 of the base 12, the image of the eye can be placed onto the flattened bottom 28 of the cap 14. Further, rather than placing a film or laminate 20 over the entire surface of the base 12, the film or laminate can be placed only in that portion where the cap 14 is mounted to the base 12. In addition, rather than cast molding the cap and base, they can be injected mold and the base can be hollow. Therefore, the spirit and scope of the appended claims should not be limited to the description of the preferred versions contained herein.

What is claimed is:

1. An artificial eye comprising:

(a) a bulbous base having a neck portion and a diametrically opposed crown, the base being comprised of a rigid, substantially unbreakable, opaque, polymeric material;

(b) mounting means extending from the neck portion of the base diametrically opposite the crown;

(c) a double convex, substantially unbreakable, polymeric, magnifying lens mounted on the crown of the base;

(d) an image of the pupil and iris of an eye between the crown and the lens, the image of the pupil and iris being visible through the lens; and (e) an exterior film of a substantially transparent, substantially unbreakable, polymeric material encasing the lens and the base, the film being at least about 3 mils thick, the lens and the film being comprised of the same polymeric material.

2. The artificial eye of claim 1 in which the base is comprised of a polyester resin.

3. The artificial eye of claim 1 in which the lens and film are comprised of an epoxy resin.

4. The artificial eye of claim 1 in which the image is a decal secured to the crown.

5. The artificial eye of claim 1 in which the image is painted onto the crown.

6. A method for forming an artificial eye comprising the steps of:

(a) forming a solid, polymeric, rigid, substantially unbreakable, opaque, bulbous base having a neck portion and a diametrically opposed crown by curing a polymeric resin in a mold;

(b) placing means for mounting the eye into the base in the neck portion diametrically opposite the crown while the polymeric resin is partially cured;

(c) placing an image of the pupil and iris of an eye on the crown;

(d) placing a rigid, substantially transparent, substantially unbreakable, magnifying, double convex lens on the base over the image; and (e) securing the placed lens to the base by encasing the base and the lens in a film comprised of a substantially transparent polymeric material, the film and the lens being formed of the same polymeric material, the film being at least about 3 mils thick.

7. The method of claim 6 in which the step of placing an image comprises painting an image onto the base.

8. The method of claim 6 in which the step of placing an image comprises placing a decal depicting an eye onto the base.

* * * * *